US006446282B1

(12) United States Patent
Wu

(10) Patent No.: US 6,446,282 B1
(45) Date of Patent: Sep. 10, 2002

(54) FURNITURE WITH INFLATABLE CUSHION

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 09/935,265

(22) Filed: Aug. 21, 2001

(51) Int. Cl.[7] ..... A47C 17/64; A47C 19/14

(52) U.S. Cl. ..... 5/115; 5/706; 5/182

(58) Field of Search ..... 297/16.1, 16.2, 297/42, 46; 5/110, 111, 112, 114, 115, 182, 706

(56) References Cited

U.S. PATENT DOCUMENTS 1,224,782 A * 5/1917 Pedersen ..... 5/115
1,788,919 A * 1/1931 Lansberry et al. ..... 5/115
2,682,670 A * 7/1954 Crump ..... 5/625
3,045,257 A * 7/1962 Knapp ..... 5/111
3,286,285 A * 11/1966 Harvey, Jr. ..... 297/452.41
4,594,743 A * 6/1986 Owen et al. ..... 5/111
6,134,727 A * 10/2000 Hwang ..... 5/110

* cited by examiner

*Primary Examiner*—Michael F. Trettel
(74) *Attorney, Agent, or Firm*—Brinks Hofer Gilson & Lione

(57) ABSTRACT

A piece of furniture includes an inflatable cushion body, a leg assembly and a coupling unit. The cushion body confines an air inflatable space therein, is provided with a valve member for inflating and deflating the cushion body, and has a bottom surface. The leg assembly is disposed below the cushion body, and has a lower portion adapted to stand on a ground surface, and an upper portion opposite to the lower portion. The coupling unit couples removably the upper portion of the leg assembly to the bottom surface of the cushion body, and includes first connecting members secured to the bottom surface of the cushion body, and second connecting members secured to the upper portion of the leg assembly to engage removably and respectively the first connecting members.

5 Claims, 5 Drawing Sheets

FURNITURE WITH INFLATABLE CUSHION

BACKGROUND OF THE INVENTION

1. Field of the Invention

The invention relates to a piece of furniture with an inflatable cushion, more particularly to a piece of furniture having a leg assembly removably coupled to an inflatable cushion for supporting the latter stably on a floor surface. The leg assembly can be easily disengaged from the inflatable cushion to facilitate storage.

2. Description of the Related Art

Referring to FIG. 1, a conventional inflatable mattress 1 is shown to confine an air inflatable space 11. The inflatable mattress 1 is provided with a valve member 12 for access of air into the air inflatable space 11 to inflate the inflatable mattress 1. After the valve member 12 is sealed, the inflatable mattress 11, which has been inflated, can serve as a bed. When use of the inflatable mattress 11 is not desired, it is only necessary to open the valve member 12 once again to allow escape of air from the air inflatable space 11 so as to deflate the inflatable mattress 1. The deflated inflatable mattress 1 can then be folded into a compact shape to facilitate storage and carrying.

Although the conventional inflatable mattress 1 is quite convenient in terms of use, storage and carrying, it is not equipped with any means to support the same on a floor surface. That is, the conventional inflatable mattress 1 is generally placed on the floor surface when in use. To prevent dirtying the inflatable mattress 1, the floor surface has to be cleaned beforehand. Otherwise, the inflatable mattress 1 may be covered with dust or even be pierced by pointed objects left lying on the floor. In addition, the dampness from the floor may be deleterious to the health of the user sleeping on the inflatable mattress 1 that lies directly on the floor surface.

SUMMARY OF THE INVENTION

Therefore, the main object of the present invention is to provide a piece of furniture with an inflatable cushion which is equipped with a removable leg assembly that can support the inflatable cushion stably on a ground surface.

Accordingly, a piece of furniture of the present invention includes an inflatable cushion body, a leg assembly and a coupling unit. The cushion body confines an air inflatable space therein, is provided with a valve member for inflating and deflating the cushion body, and has a bottom surface. The leg assembly is disposed below the cushion body, and has a lower portion adapted to stand on a ground surface, and an upper portion opposite to the lower portion. The coupling unit couples removably the upper portion of the leg assembly to the bottom surface of the cushion body, and includes first connecting members secured to the bottom surface of the cushion body, and second connecting members secured to the upper portion of the leg assembly to engage removably and respectively the first connecting members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
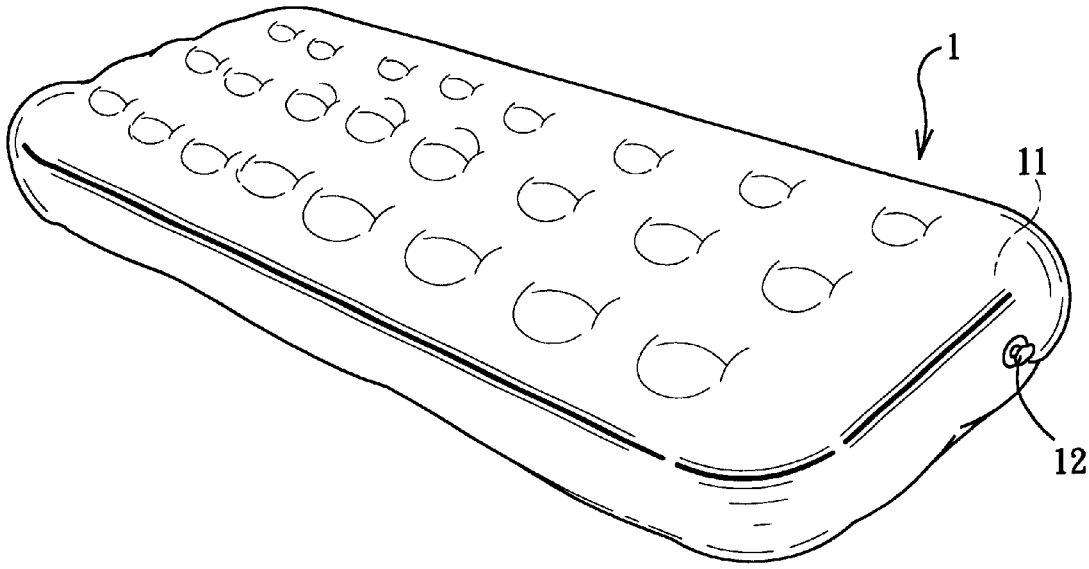
F I G. 1 PRIOR ART
FIG. 1 is a perspective view of a conventional inflatable mattress.
Figure 2:
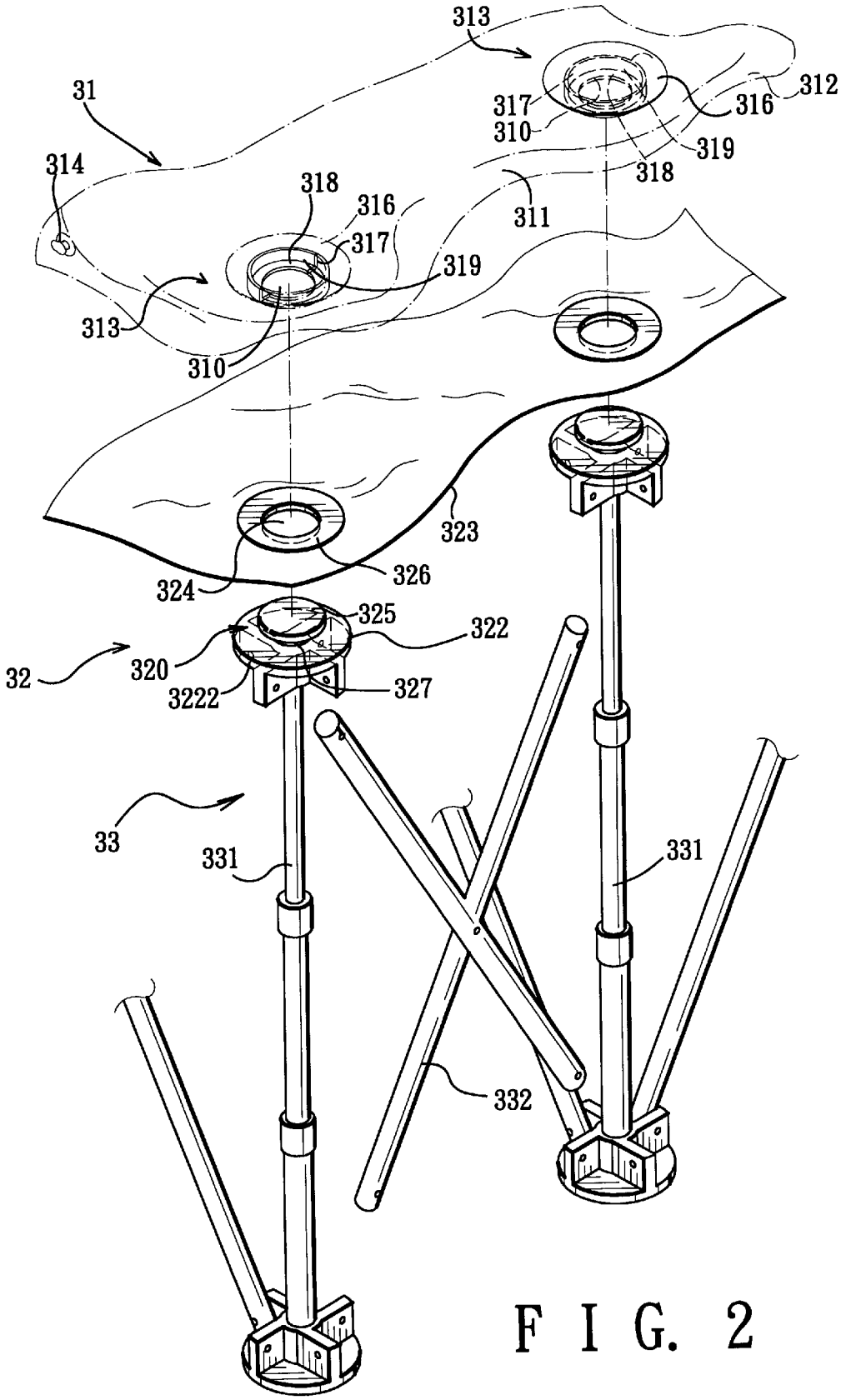
FIG. 2 is an exploded perspective view of a preferred embodiment of a piece of furniture according to the invention in part.
Figure 3:
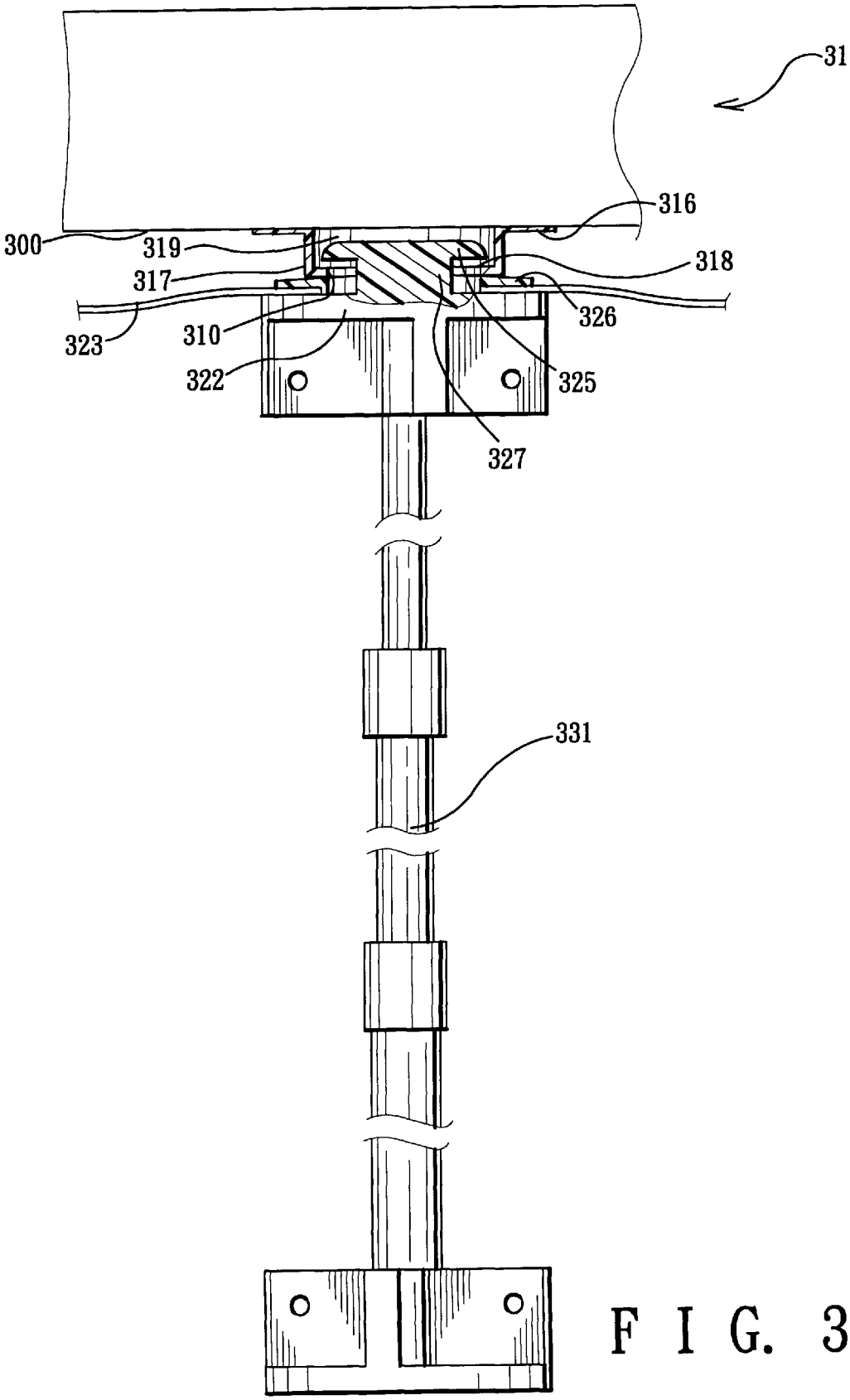
FIG. 3 is a fragmentary sectional view of the preferred embodiment in an assembled state, illustrating how a leg assembly is coupled to a cushion body prior to inflation.

Referring to FIGS. 2 and 3, the preferred embodiment of a piece of furniture according to the present invention is shown to include an inflatable cushion body 31, a leg assembly 33, and a coupling unit 32.

The cushion body 31 has an enclosed surrounding wall 311 confining an air inflatable space 312 therein. The cushion body 31 is provided with a valve member 314 for inflating and deflating the cushion body 31, and has a bottom surface 300.

The leg assembly 33 is disposed below the cushion body 31, and has a lower portion adapted to stand on a ground surface, and an upper portion opposite to the lower portion. The leg assembly 33 includes a plurality of upright leg members 331 and a plurality of foldable cross members 332, each of which is connected pivotally to an adjacent pair of the upright leg members 331.

The coupling unit 32 couples removably the upper portion of the leg assembly 33 to the bottom surface 300 of the cushion body 31. The coupling unit 32 includes a number of first connecting members 313 secured to the bottom surface 300 of the cushion body 31, and a number of second connecting members 320 secured to the upper portion of the leg assembly 33 to engage removably and respectively the first connecting members 313.

Each of the first connecting members 313 has a securing portion 316 connected to the bottom surface 300 of the cushion body 31, an annular portion 317 extending downwardly from the securing portion 316 and having a lower rim, and a flexible baffle ring 318 extending radially and inwardly from the lower rim. Furthermore, each of the first connecting members 313 confines a receiving space 319. The baffle ring 318 defines an opening 310 that is communicated with the receiving space 319.

Each of the second connecting members 320 has a wider retaining portion 325 and a narrower trunk portion 327 connected coaxially to the wider retaining portion 325. The wider retaining portion 325 and the narrower trunk portion 327 may be integrally formed. The opening 310 defined by the baffle ring 318 has a diameter that is smaller than that of the wider retaining portion 325 and larger than that of the narrower trunk portion 327 of the respective one of the second connecting members 320, thereby enabling the baffle ring 318 to retain the wider retaining portion 325 of the respective one of the second connecting members 320 in the receiving space 319 after the wider retaining portion 325 is squeezed through the opening 310.

The coupling unit 32 further includes a number of positioning members 322 respectively secured to the upright leg members 331. Each of the positioning members 322 has a wide base section 3222 mounted on the upper portion of the leg assembly 33. The narrower trunk portion 327 of a respective one of the second connecting members 320 is anchored to the wide base section 3222. The wide base section 3222 has a diameter larger than that of the opening 310 in a respective one of the first connecting members 313.

The coupling unit 32 further includes a supporting fabric 323 overlying the wide base sections 3222 of the positioning members 322, and formed with a number of through holes 324 that permit the wider retaining portions 325 of the second connecting members 320 to extend there through. The supporting fabric 323 is sandwiched between the positioning members 322 and the first connecting members 313. In this embodiment, the supporting fabric 323 has an upper surface provided with a number of reinforcing pieces 326, each of which surrounds a respective one of the through holes 324.

During assembly, referring to FIG. 3, the wider retaining portion 325 of the respective second connecting member 320 is squeezed through the opening 310 defined by the flexible baffle ring 318 of the respective first connecting member 313 such that the wider retaining portion 325 is retained in the receiving space 319. Thus, the upper portion of the leg assembly 33 is coupled to the bottom surface 300 of the cushion body 31. At this time, the securing portions 316 of the first connecting members 313 can support relatively large areas of the cushion body 31 so that the cushion body 31 can be stretched out in a relatively flat state. Similarly, the reinforcing pieces 326 on the upper surface of the supporting fabric 323 enable the supporting fabric 323 to be stretched out relatively flat below the cushion body 31.

Figure 4:
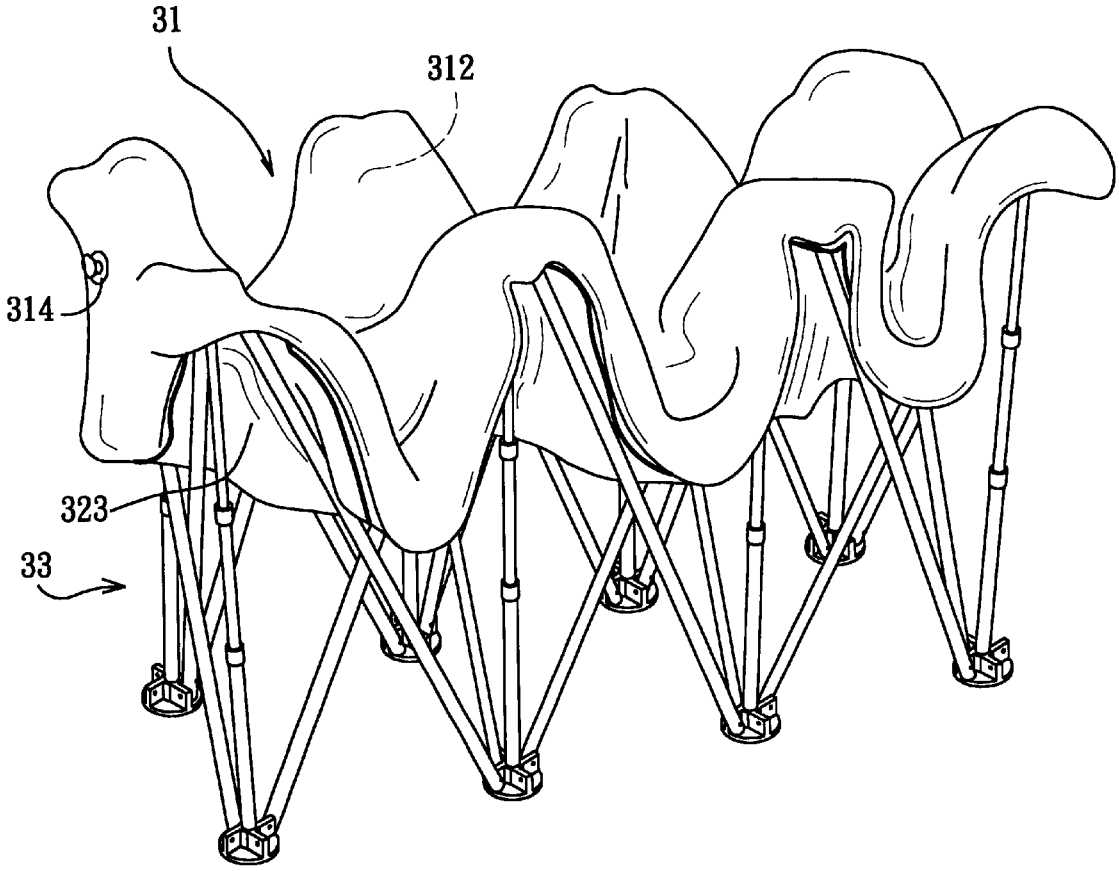
FIG. 4 is a perspective view of the preferred embodiment in an assembled state, illustrating how the leg assembly is coupled to the cushion body prior to inflation.
Figure 5:
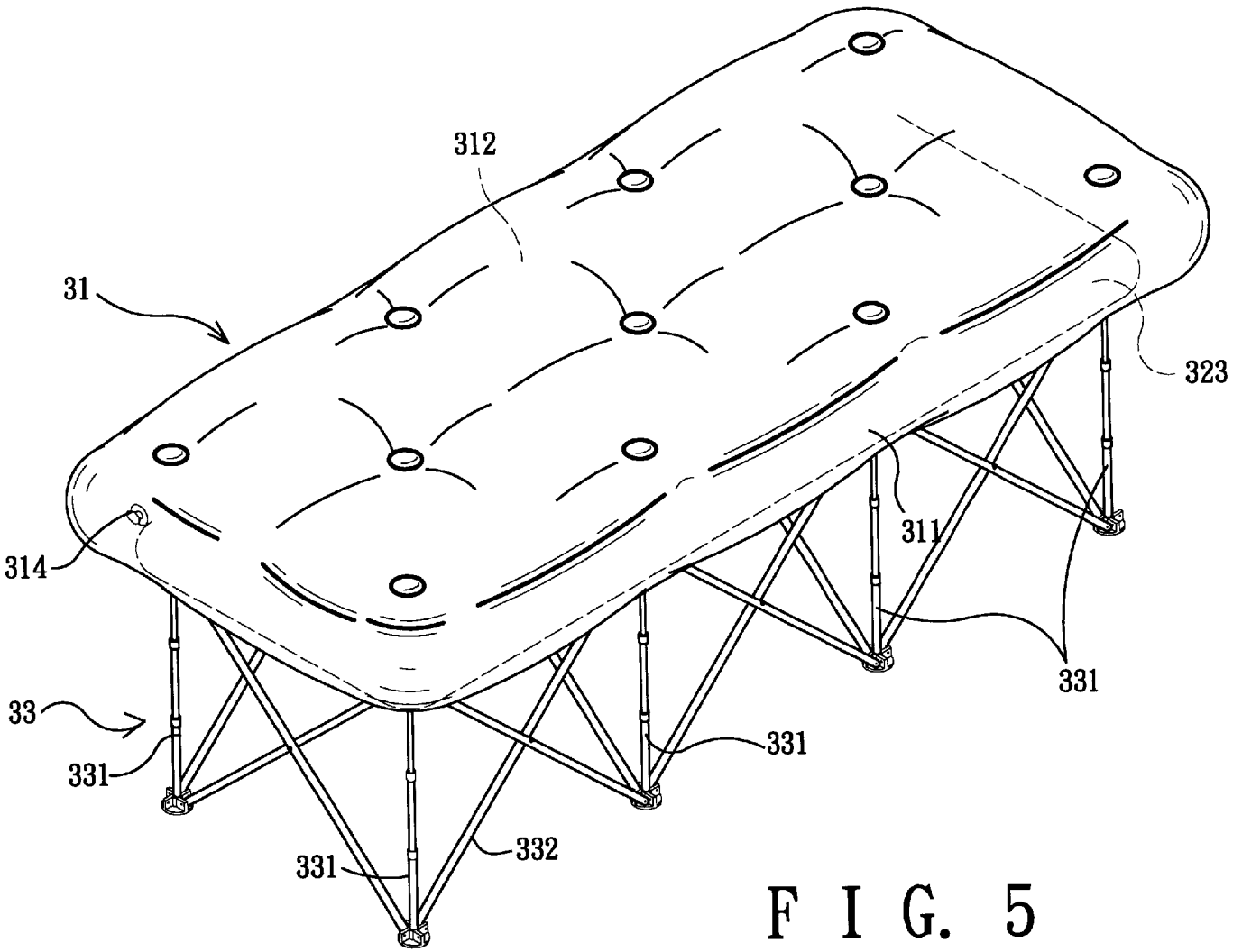
FIG. 5 is perspective view of the preferred embodiment in a state of use, illustrating how the cushion body and the leg assembly automatically spread out after inflation of the cushion body.

With further reference to FIGS. 4 and 5, in combination with FIG. 3, after each of the second connecting members 320 is coupled to the corresponding one of the first connecting members 313 on the bottom surface 300 of the cushion body 31 in the manner described in the preceding paragraph, air is introduced into the air inflatable space 312 inside the cushion body 31 via the valve member 314 to inflate the cushion body 31 so that the cushion body 31, together with the leg assembly 33, spreads out. The valve member 314 is then sealed to keep the cushion body 31 in the inflated state. At the same time, the supporting fabric 323, which is also stretched out below the cushion body 31, supports the entire bottom surface 300 of the cushion body 31. In addition, as shown in FIG. 3, the securing portions 316 of the first connecting members 313 and the reinforcing pieces 326 enable a more even contact between the cushion body 31 and the supporting fabric 323 so that the cushion body 31 can be flatly and firmly supported by the leg assembly 33 on the ground surface.

To collapse the furniture of the present invention, it is only necessary to open the valve member 314 to allow the air inside the air inflatable space 312 to escape to thereby deflate the cushion body 31, as shown in FIG. 4. Then, the leg assembly 33 along with the second connecting members 320 is removed from the first connecting members 313 on the cushion body 31. Thus, the cushion body 31 and the leg assembly 33 can be collapsed or folded separately to facilitate storage or carrying.

It is noted that the number of upright leg members 331 depends on the size of the cushion body 31. Furthermore, the furniture according to the present invention can be in the form of a bed, a chair, etc.

In sum, since the cushion body 31 is supported on the ground surface by means of the leg assembly 33, it will not come into direct contact with the ground surface. Therefore, the aforesaid problems associated with the conventional inflatable mattress can be eliminated.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A piece of furniture, comprising:

an inflatable cushion body confining an air inflatable space therein, said cushion body being provided with a valve member for inflating and deflating said cushion body, and having a bottom surface;

a leg assembly disposed below said cushion body and having a lower portion adapted to stand on a ground surface, and an upper portion opposite to said lower portion;

a coupling unit for coupling removably said upper portion of said leg assembly to said bottom surface of said cushion body, said coupling unit including a number of first connecting members secured to said bottom surface of said cushion body, each of said first connecting members having a securing portion connected to said bottom surface of said cushion body, an annular portion extending downwardly from said securing portion and having a lower rim, and a flexible baffle ring extending radially and inwardly from said lower rim, each of said first connecting members confining a receiving space, said baffle ring defining an opening that is communicated with said receiving space; and a number of second connecting members secured to said upper portion of said leg assembly to engage removably and respectively said first connecting members.

2. The piece of furniture as claimed in claim 1, wherein each of said second connecting members has a wider retaining portion and a narrower trunk portion connected coaxially to said wider retaining portion, said opening defined by said baffle ring having a diameter that is smaller than that of said wider retaining portion and larger than that of said narrower trunk portion of the respective one of said second connecting members, thereby enabling said baffle ring to retain said wider retaining portion of the respective one of said second connecting members in said receiving space after said wider retaining portion is squeezed through said opening.

3. The piece of furniture as claimed in claim 2, wherein said coupling unit further includes a number of positioning members, each of which has a wide base section mounted on said upper portion of said leg assembly, said narrower trunk portion of a respective one of said second connecting members being anchored to said wide base section, said wide base section having a diameter larger than that of said opening in a respective one of said first connecting members.

4. The piece of furniture as claimed in claim 3, wherein said coupling unit further includes a supporting fabric overlying said wide base sections of said positioning members, and formed with a number of through holes that permit said wider retaining portions of said second connecting members to extend therethrough, said supporting fabric being sandwiched between said positioning members and said first connecting members.

5. A piece of furniture, comprising:

an inflatable cushion body confining an air inflatable space therein, said cushion body being provided with a valve member for inflating and deflating said cushion body, and having a bottom surface;

a leg assembly disposed below said cushion body and having a lower portion adapted to stand on a ground surface, and an upper portion opposite to said lower portion, and a coupling unit for coupling removably said upper portion of said leg assembly to said bottom surface of said cushion body, said coupling unit including a number of first connecting members secured to said bottom surface of said cushion body, and a number of second connecting members secured to said upper portion of said leg assembly to engage removably and respectively said first connecting members, wherein said leg assembly includes a plurality of upright leg members and a plurality of foldable cross members, each of which is connected pivotally to an adjacent pair of said upright leg members, said second connecting members being secured to said upright leg members.

* * * * *